United States Patent [19]

Sholes

[11] Patent Number: 4,856,111

[45] Date of Patent: Aug. 15, 1989

[54] PERSPIRATION SHIELD

[76] Inventor: Bessie M. Sholes, 1439 76th Ave., Oakland, Calif. 94621

[21] Appl. No.: 215,816

[22] Filed: Jul. 6, 1988

[51] Int. Cl.[4] ..... A41D 27/13

[52] U.S. Cl. ..... 2/56; 2/58

[58] Field of Search ..... 2/53, 54, 55, 56, 57, 2/58

[56] References Cited

U.S. PATENT DOCUMENTS

| | | | |
|---|---|---|---|
| 1,078,443 | 11/1913 | Just | 2/53 |
| 1,083,140 | 12/1913 | Rindskopf | 2/53 |
| 1,108,427 | 8/1914 | Brennan | 2/53 |
| 1,272,684 | 7/1918 | Levi | 2/53 |
| 1,291,073 | 1/1919 | Miller | 2/53 |
| 2,344,781 | 3/1944 | Mullen | 2/53 |
| 2,545,312 | 3/1951 | Saari et al. | 2/53 |
| 3,588,916 | 6/1971 | Glatt | 2/53 |
| 4,485,492 | 12/1984 | Sneider | 2/53 X |
| 4,663,780 | 5/1987 | Rawlings et al. | 2/53 |
| 4,747,162 | 5/1988 | Vanaghihara | 2/53 |

*Primary Examiner*—Werner H. Schroeder
*Assistant Examiner*—Jeanette E. Chapman
*Attorney, Agent, or Firm*—Bielen & Peterson

[57] ABSTRACT

A disposable perspiration shield generally for use with an upper torso garment utilizing a first layer of adsorbent tissue which lies next to a second layer of adsorbent material. A third layer of adsorbent swab material is protected on one side by the second layer and on another side by a fourth layer of adsorbent material. A fifth layer of water repellent material is placed adjacent the swab protecting layer and surrounded by a sixth layer of sound adsorbing material. The first through sixth layers of material form a unit which is adherent with respect to the torso garment.

5 Claims, 1 Drawing Sheet

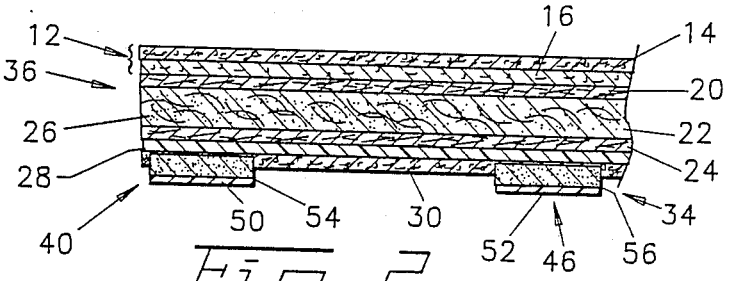
Fig. 2
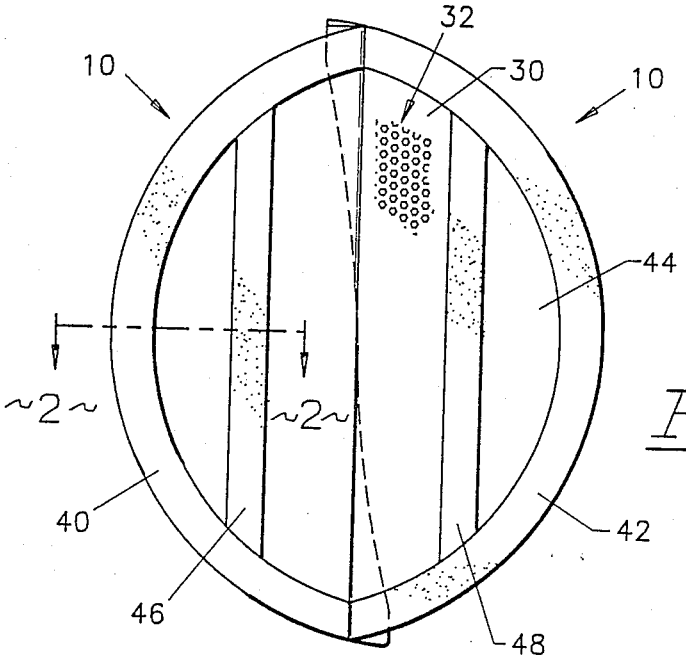
Fig. 1
Fig. 3
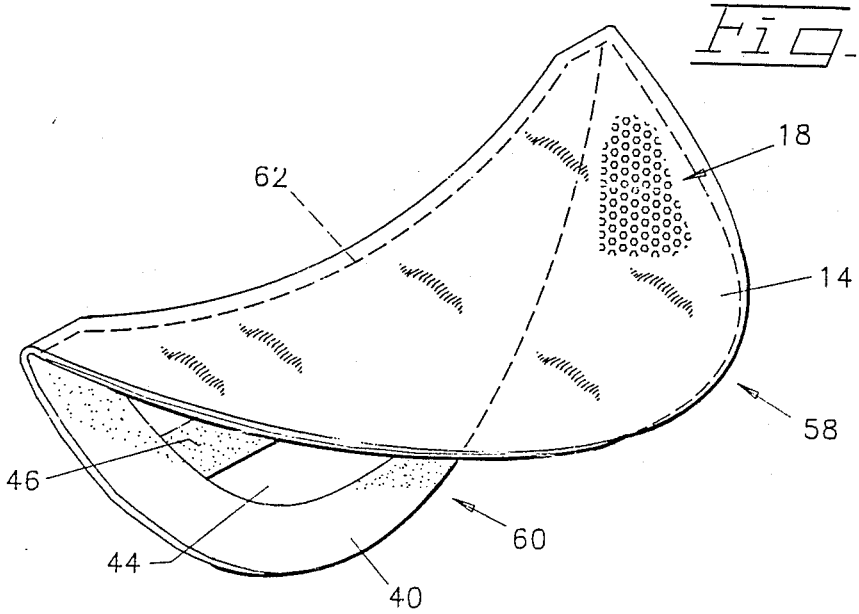

PERSPIRATION SHIELD

BACKGROUND OF THE INVENTION

The present invention relates to a novel disposable perspiration shield which may be used to protect garments.

Human perspiration often stains an outer garment, especially in hot and humid climates. In the past antiperspirant chemicals have been used, but such chemicals work for a limited time and are often known to fail under stressful conditions. In addition, clothing liners have been employed to intercept perspiration emanating from the human body from reaching the outer garment. Unfortunately, such liners promote the perspiration process and are often very uncomfortable to wear in hot and humid weather conditions.

A perspiration controlling device which solves the problems of the prior art would be a notable advance in the art of personal hygiene devices.

SUMMARY OF THE INVENTION

In accordance with the present invention, a novel and useful perspiration shield for garments is provided.

The perspiration shield of the present invention utilizes a first layer of absorbent tissue material, typically paper or cloth. A second layer of absorbent material is placed adjacent the first layer of absorbent tissue. A second layer of absorbent material is also included in the present invention and is placed adjacent the first layer. A third layer of absorbent swab material is held in place between the second layer and a fourth layer of absorbent material. The third layer of absorbent swab material may possess a thickness greater than the first and second layers and be dispersed with odor absorbing powder, such as activated charcoal.

The shield of the present invention also includes a fifth layer of water repellent material which is placed adjacent the fourth swab containing absorbent layer. Such water repellent material may take the form of rubber, plastic, or the like. Adjacent the fifth layer of water repellent material is a sixth layer of sound absorbing material which may also be moisture absorbent. The first through sixth layers of material are formed in a sandwiched relationship creating a moisture and sound suppressing unit. The unit would be shaped to fit across the juncture of the sleeve and chest portions of a garment, immediately below the armpit of the use of the garment.

Means is also provided for adhering or fixing the moisture and and sound suppressing unit to the garment. Such adhering means may take the form of adhesion strips which are fixed to the water repellent material and ar removably held to the garment.

It may be apparent that a novel and useful disposable perspiration shield is provided.

It is therefore an object of the present invention to provide a disposable perspiration shield which may be easily inserted into a garment to protect the same from perspiration stains.

It is another object of the present invention to provide a disposable perspiration shield which is comfortable to wear and is easily removed after wear.

A further object of the present invention is to provide a disposable perspiration shield which does not produce a rustling noise when distorted.

A further object of the present invention is to provide a disposable perspiration shield which deodorizes and absorbs moisture.

The invention possesses other objects and advantages especially as concerns particular characteristics and features thereof which will become apparent as the specification continues.

BRIEF DESCRIPTION OF THE DRAWINGS

FIG. 1 is a bottom plan vie of the present invention.

FIG. 2 is a sectional view taken along line 2—2 of FIG. 1.

FIG. 3 is a top right perspective view of the present invention.

For a better understanding of the invention reference is made to the following detailed description of the preferred embodiments thereof which should be taken in conjunction with the hereinabove described drawings.

DESCRIPTION OF THE PREFERRED EMBODIMENTS

Various aspects of the present invention will evolve from the following detailed description of the preferred embodiments which should be referenced to the previously described drawings.

The invention as whole is depicted in the drawings by reference character 10. The perspiration shield 10 includes as one of its elements a first layer of moisture absorbing tissue 12. Tissue layer 12 includes a first portion 14 of perforated absorbent tissue and a second portion 16 of fibrous absorbent tissue. First portion 14 may be formed with a plurality of perforations 18, FIG. 3, which add to the comfort of shield 10 and tend to reduce the crinkle or rustle which may be produced by shield 10, detailed hereinafter. Second portion 16 tends to add strength to perforated first portion 14 in the formation of first layer 12.

With further reference to FIG. 2, it may be observed that second layer 20, third layer 22, and fourth layer 24 are formed beneath first layer 12. Second layer 20 and fourth layer 24 are constructed of absorbent material such as paper, and maybe connected to form a sack for enclosing third layer 22. It should be noted that third layer 22 is of a greater thickness than first layer 12. Third layer 22 is formed of an absorbent swab material and may include dispersed activated charcoal powder 26. In addition, the second layer 20 prevents migration of activated charcoal powder 26 from swab layer 22.

A fifth layer 28 of water repellent material is also defined to lie adjacent the fourth layer 24. Such water repellent layer 28 may be formed of rubber, plastic, coated paper, and the like. Sixth layer 30 is constructed to lie immediately adjacent fifth layer 28. Sixth layer 30 may be identical to first layer 12, a perforated water absorbent material having plurality of openings 32, FIG. 1. The pocked configuration of sixth layer 30 serves to suppress the crinkling or rustling sound produced by water repellant layer 28 alone. First layer 12, second layer 20, third layer 22, fourth layer 24, fifth layer 28, and sixth layer 30 form a moisture and sound suppressing unit 36. Means 38 is provided for adhering unit 36 to a garment, such as a shirt, dress, suit, and the like (not shown) means 38 may take the form of adhesive strips 40 and 42 which extend around the perimeter of the bottom surface 44 of shield 10, and strips 46 and 48 which extend transversely relative to bottom surface 44 of shield 10, FIG. 1. With reference to FIG. 2 adhesive strips 40 and 46 are depicted and include removable tabs 50 and 52 which expose adhesive surfaces 54 and 56 for contact with a garment. Furthermore, adhesive strips, exemplified by strips 40 and 46 on FIG. 2, attach directly to water repellent layer 28.

Shield 10, including the layered structure hereinbefore described, is formed into a saddle-shaped object having a pair of flaps 58 and 60. Each flap, 58, 60 is generally crescent-shaped. The upper crease 62 of shield 10 is intended to lie on a garment juncture between the sleeve and chest covering portion of the garment i.e. beneath the arm pit of the user. Thus, first portion 14 of first layer 12 would lie immediately adjacent or in contact with the arm pit of the user.

In operation, the user would remove adhesive tabs 54 and 56 covering adhesive strips 40 and 46, as well as other tabs (not shown) covering adhesive strips 42 and 48. The shield 10 would then be placed over the juncture between the sleeve and chest covering portion of the garment. A user would then put o the garment such that first portion 14 and first layer 12 would lie immediately adjacent the arm pit of the user. Any perspiration from the user would be absorbed by the first through fourth layers of unit 36. Moisture passing through the first four layers of unit 36 would be blocked from further passage by water repellent layer 28. Noise suppressing layer 30 would prevent crinkling or rustling of the shield 10 while in use. Activated charcoal powder 26 would tend to absorb any odors associated with the perspiration emanating from the user. After use, shield 10 may be removed from the garment and disposed. Thus, the garment is protected against perspiration, moisture and the stains associated therewith.

While in the foregoing embodiments of the present invention have been set forth in considerable detail for the purpose of making a complete disclosure of the invention it may be apparent to those of skill in the art that numerous changes may be made in such details without departing from the spirit and principles of the invention.

What is claimed is:

1. A disposable perspiration shield for use with an upper torso garment comprising:

a. a first layer of absorbent tissue;

b. a second layer of absorbent tissue; lying adjacent said first layer;

c. a third layer of absorbent swab material, said third layer possessing a thickness grater than said first layer, and lying adjacent said second layer;

d. a fourth layer of absorbent material; lying adjacent said third layer;

e. a fifth layer of water repellent material, said fifth layer lying adjacent said fourth layer;

f. a sixth layer of sound suppressing material lying adjacent said fifth layer, said first, second, third, fourth, fifth and sixth layers of material being in sandwiched relationship to form a moisture absorbing and sound suppressing unit; and g. means for adhering said moisture absorbing and sound suppressing unit to the torso garment, said adhering means including an adhesive strip being fastened to the fifth layer of water repellent material, extending through said sixth layer and being capable of being removably fastened to the torso garment.

2. The disposable perspiration shield of claim 1 in which said first layer of absorbent tissue includes a first portion of perforated absorbent tissue and a second portion of fibrous absorbent tissue.

3. The disposable perspiration shield of claim 1 in which said third layer of absorbent swab includes dispersed odor absorbing powder.

4. The disposable perspiration shield of claim 2 in which said first portion of said first layer and said sixth layer are of identical material.

5. The disposable perspiration shield of claim 3 in which said second and fourth layers form a sack for enclosing said third layer including dispersed odor absorbing powder.

* * * * *